United States Patent [19]

Nino

[11] Patent Number: 4,851,968

[45] Date of Patent: Jul. 25, 1989

[54] AUTOMOTIVE PROJECTOR TYPE HEADLIGHT

[75] Inventor: Naohi Nino, Kitawaki, Japan

[73] Assignee: Koito Seisakusho Co., Ltd., Japan

[21] Appl. No.: 250,881

[22] Filed: Sep. 29, 1988

[30] Foreign Application Priority Data

Sep. 29, 1988 [JP] Japan ..... 62-245261

[51] Int. Cl.[4] ..... F21V 5/04; F21V 7/09; F21V 13/12

[52] U.S. Cl. ..... 362/61; 362/299; 362/308; 362/327

[58] Field of Search ..... 362/61, 80, 83, 308, 362/299, 327, 328, 329, 346, 298

[56] References Cited

U.S. PATENT DOCUMENTS

| | | | |
|---|---|---|---|
| 4,100,594 | 7/1978 | Gould | 362/308 |
| 4,511,955 | 4/1985 | Ernst et al. | 362/347 |
| 4,562,519 | 12/1985 | Deves | 362/308 |
| 4,669,032 | 5/1987 | Lietar et al. | 362/61 |
| 4,685,036 | 8/1987 | Loewe et al. | 362/61 |
| 4,686,610 | 8/1987 | Cibie et al. | 362/61 |
| 4,727,458 | 2/1988 | Droste et al. | 362/61 |
| 4,768,135 | 8/1988 | Kretschmer et al. | 362/277 |
| 4,772,987 | 9/1988 | Kretschmer et al. | 362/61 |
| 4,796,171 | 1/1989 | Lindae et al. | 362/308 |
| 4,797,790 | 1/1989 | Brödling et al. | 362/61 |

*Primary Examiner*—Ira S. Lazarus
*Assistant Examiner*—Richard R. Cole
*Attorney, Agent, or Firm*—Sughrue, Mion, Zinn, Macpeak, and Seas

[57] ABSTRACT

A projector type headlight is disclosed, which comprises a concave reflector having first and second focuses on an optical axis thereof; a light source located on or at least near the first focus of the concave reflector; a shade plate positioned in front of the concave reflector, the shade plate having an upper edge located in the vicinity of the second focus of the concave reflector; and a converging lens located in front of the shade plate in such a manner that a focus of the lens is positioned on the upper edge of the shade plate, wherein the optical axis of the concave reflector is inclined with respect to an optical axis of the converging lens.

13 Claims, 13 Drawing Sheets

AUTOMOTIVE PROJECTOR TYPE HEADLIGHT

BACKGROUND OF THE INVENTION

1. Field of the Invention

The present invention relates in general to automotive headlights, and more particularly to automotive headlights of a so-called "projector type" which comprises an electric bulb for generating light, a concave reflector for reflecting the light forward, a shade placed in front of the concave reflector for partially shading and thus contouring the reflected light, and a converging lens placed in front of the shade for projecting the contoured light beam forward.

2. Description of the Prior Art

In order to clarify the task of the present invention, one of conventional projector type headlights will be described with reference to FIGS. 14 and 15.

FIG. 14 shows schematically the conventional headlight which is generally designated by reference "a". This headlight "a" is used as a lower beam projector of automobiles. As is known, the lower beam is the light beam intended for a forward neighbouring illumination particularly used when the vehicle is meeting or following other vehicles.

Designated by "b" is a concave light reflector which has an ellipsoidal light reflecting surface "c" formed on an inside face thereof. A light source "d" (viz., a filament of an electric bulb) is placed on a first focus $F_1$ of the reflecting surface "c" of the reflector "b". A lower half of the light source "d" is concealed by a cap "e", so that the light rays emitted from the light source "d" do not travel to a lower half section of the reflecting surface "c". That is, only the light rays emitted upward from the light source "d" are reflected forward by the upper half section of the reflecting surface "c" and converged at a second focus $F_2$ of the reflecting surface "c". A shade plate "f" is arranged near the second focus $F_2$ in such a position that a stepped upper edge "g" thereof is positioned just behind the second focus $F_2$. A converging lens "h" is arranged in front of the shade plate "f" in such a position that a focus $F_c$ of the lens "h" is placed on the stepped upper edge "g" of the shade plate "f". The reflector"b" and the converging lens "h" are coaxially arranged. The line denoted by "Xl–Xm" is the common axis of these two members "b" and "h".

When, with the arrangement as described hereinabove, the light source "d" is energized to light, the light rays "i" emitted therefrom are reflected forward by the upper half section of the concave reflector "b" and converged at the second focus $F_2$ of the reflector "b". Due to presence of the stepped upper edge "g" of the shade plate "f" near the second focus $F_2$, part of the reflected light rays "i" from the reflector "b" is shaded. Accordingly, the light beam projected forward from the lens "h" has such a contoured cross-sectional pattern "j" as shown in FIG. 15. That is, the projected beam from the lens "h" has an inverted image of the upper edge portion of the shade plate "f". The bent line "k" in the pattern "j" in FIG. 15 is provided by the stepped upper edge of the shade plate "f".

However, due to its inherency in construction, the above-mentioned conventional headlight "a" has such a drawback that the projected beam pattern "j" has a specially colored (viz., blue colored) zone "1" along the bent line "k".

That is, since, in the conventional headlight "a", the light rays from the reflector "b" are permitted to go through only the lower half of the lens "h", the light refracting property (viz., spectral characteristic) of only the lower half of the lens "h" works, so that color cancelling effect on the visible spectrum by the lens "h" is substantially lost or at least lowered causing the blue light "$i_B$" undergoing the greatest amount of deflection to stand out clearly near the axis "Xl–Xm". This phenomenon causes the zone "1" of the projected pattern "j" to be illuminated in blue.

SUMMARY OF THE INVENTION

It is therefore an object of the present invention to provide a projector type headlight which is free of the above-mentioned drawback.

According to the present invention, there is provided a projector type headlight in which light rays having passed through an upper edge of a shade plate are evenly applied to the incident face of a coverging lens allowing the same to function optimally.

According to the present invention, there is provided a projector type headlight which comprises a concave reflector having first and second focuses on an optical axis thereof; a light source located on or at least near the first focus of the concave reflector; a shade plate positioned in front of the concave reflector, the shade plate having an upper edge located in the vicinity of the second focus of the concave reflector; and a converging lens located in front of the shade plate in such a manner that a focus of the lens is positioned on the upper edge of the shade plate, wherein the optical axis of the concave reflector is inclined with respect to an optical axis of the converging lens.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
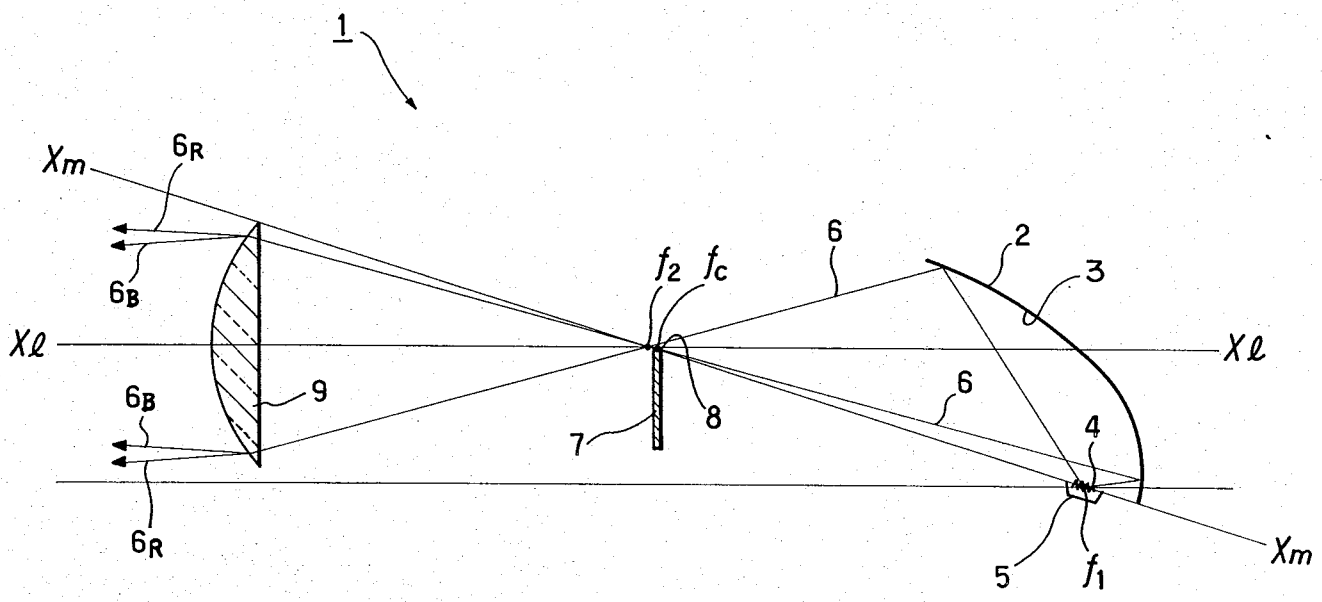
FIG. 1 is a schematical illustration of a projector type headlight according to the present invention.
Figure 2:
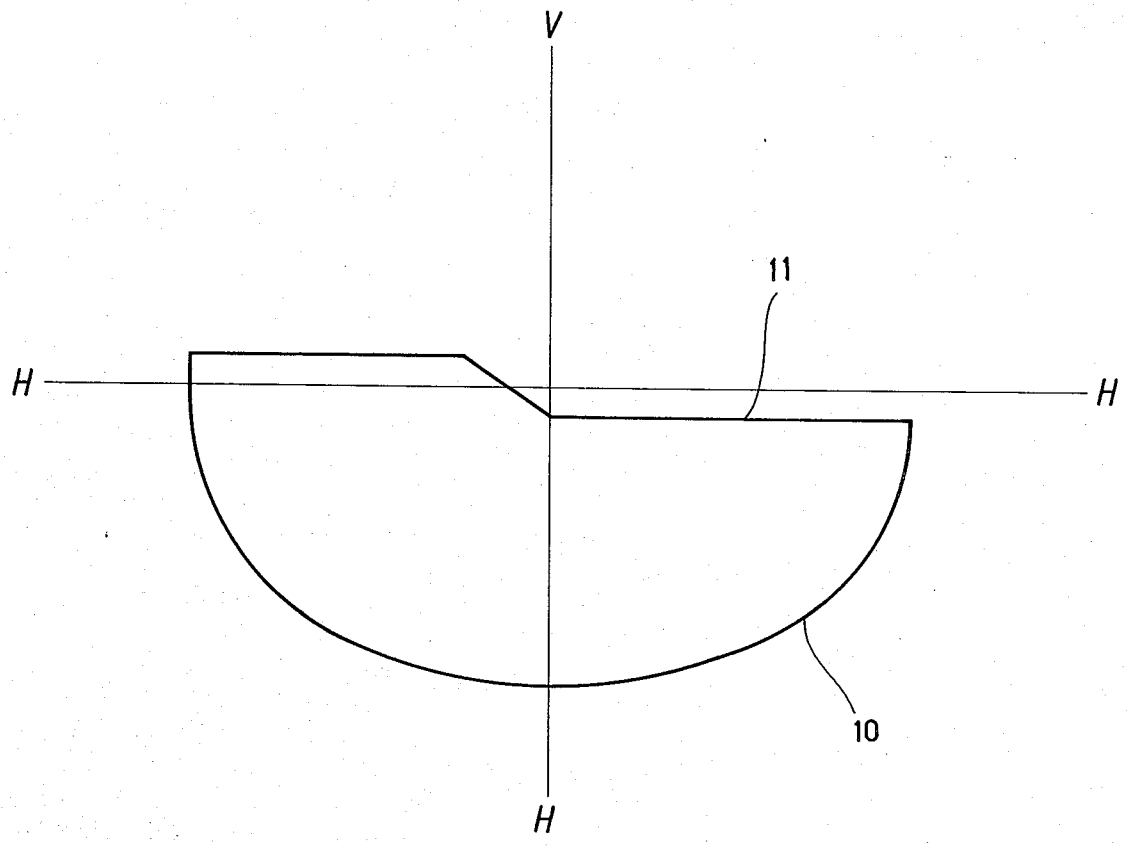
FIG. 2 is a drawing of a projected beam pattern provided by the headlight of the present invention.

Referring to FIGS. 1 and 2, particularly FIG. 1, there is schematically illustrated a projector type headlight 1 of the present invention, which is used as, for example, a lower beam projector of automobiles.

Designated by numeral 2 is a concave light reflector which has an ellipsoidal light reflecting surface 3 formed on an inside face thereof. As shown, a lower half part of the reflector 2 is cut out. For the reason which will be clarified hereinafter, the reflector 2 is arranged to face forwardly upwardly having the axis Xm—Xm thereof inclined by a given angle with respect to an after-mentioned axis Xl—Xl. The ellipsoidal light reflecting surface 3 has first and second focuses $f_1$ and $f_2$ on the axis Xm13 Xm.

Designated by numeral 4 is a light source. More particularly, the light source is a filament of an electric bulb, which is located on or at least near the first focus $f_1$ of the light reflecting surface 3.

Designated by numeral 5 is a cap which is arranged to conceal a lower half of the filament 4. Accordingly, only the light rays 6 emitted upward from the filament 4 are reflected forward by the ellipsoidal light reflecting surface 3 and converged at the second focus $f_2$ Practically, the bundle of the light rays 6 converged at the second focus $f_2$ has a certain sectional area because the filament 4 has certain dimensions.

In front of the concave reflector 2, there is arranged a shade plate 7 which has a stepped upper edge 8. The shade plate 7 is arranged in such a position that the stepped upper edge 8 thereof is placed near the second focus $f_2$ of the reflector 2. Accordingly, a lower part of the bundle of the light rays 6 from the reflector 2 is blocked by the shade plate 7. That is, only an upper part of the bundle is permitted to travel forward beyond the shade plate 7.

A converging lens 9 is arranged in front of the shade plate 7. That is, the lens 9 is arranged in such a manner that a focus $f_c$ thereof is placed on the stepped upper edge 8 of the shade plate 7. Designated by Xl—Xl is the optical axis of the lens 9, which is substantially horizontal. It is to be noted that the axis Xl—Xl of the lens 9 and the axis Xm—Xm of the reflector 2 intersect with a given angle defined therebetween. That is, the reflector 2 and the lens 9 are not coaxially arranged in accordance with the present invention.

Because of the same reason as has been described in the part of the conventional headlight "a", when the light source 4 is energized, the lens 9 projects forward a light beam in which an inverted image of the stepped upper edge 8 of the shade plate 7 is included. That is, the projected light beam includes such a contoured cross-sectional pattern 10 as shown in FIG. 2.

The non-coaxial arrangement of the reflector 2 and the lens 9 brings about elimination of the undesired blue coloring of the projected pattern for the reasons which will be described in the following.

Due to the non-coaxial arrangement, the light rays 6 having passed beyond the stepped upper edge 8 of the shade plate 7 can equally or evenly pass through the entire area of the lens 9. That is, as will be understood from FIG. 1, on undergoing refraction at the lens 9, the light from the upper edge 8 of the shade plate 7 is broken up into the spectral colors. However, at the upper half of the lens 9, the blue color $6_B$ is refracted downward relative to the red color $6_R$, while at the lower half of the lens 9, the red light $6_R$ is refracted downward relative to the blue color $6_B$, so that at the pattern 10 formed by the projected beam, the light rays corresponding to the spectral colors are combined to obtain a white (viz., colorless) light. Thus, the projected pattern 10 is prevented from having a specially colored zone along the line 11.

In the following, several modifications of the projector type automotive headlights, to which the present invention is practically applied, will be described with reference to the accompanying drawings.

Because these modifications are of a so-called double beam type projector which includes, as a base structure, the above-mentioned headlight 1 (see Fig. 1) of the present invention, description on the base structure will be omitted or briefly made in the following.

Figure 3:
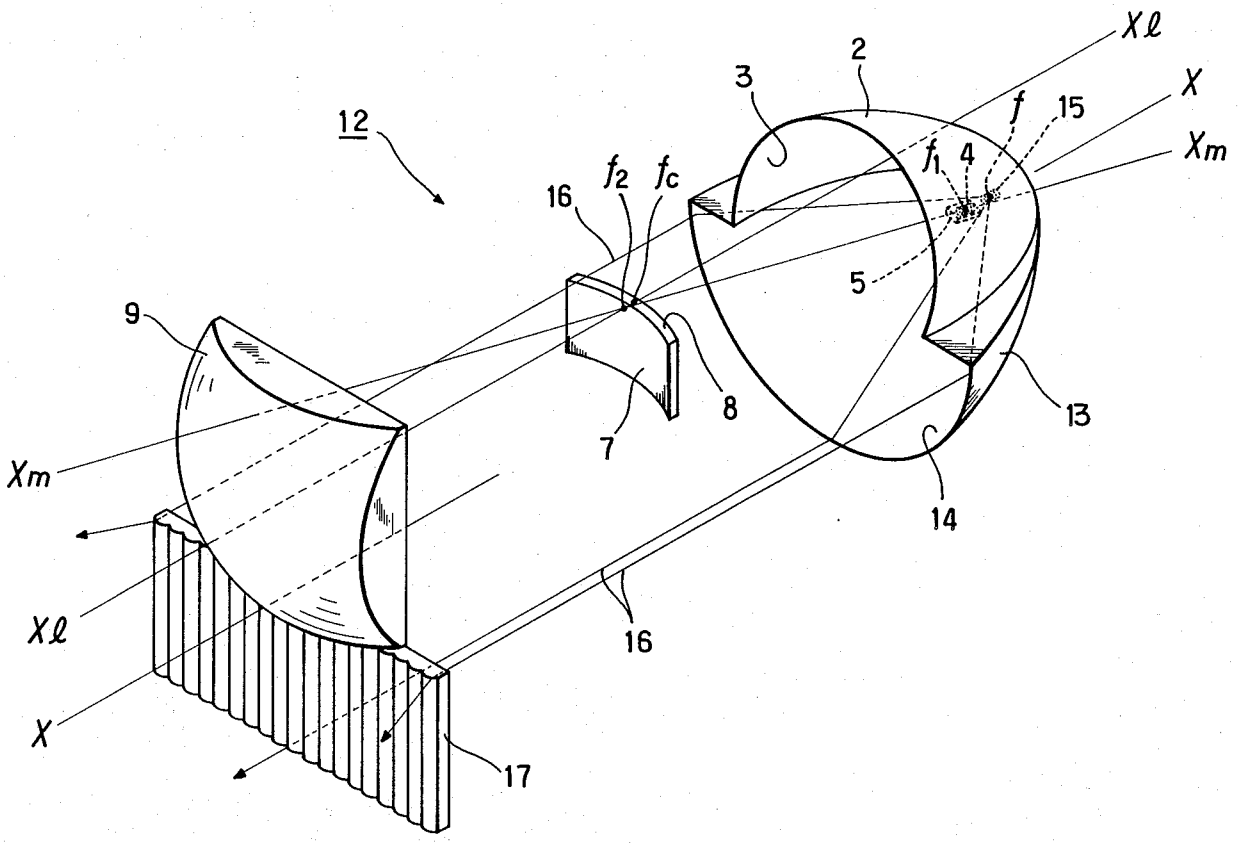
FIG. 3 is a schematically illustrated first modification of the headlight of the present invention.
Figure 4:
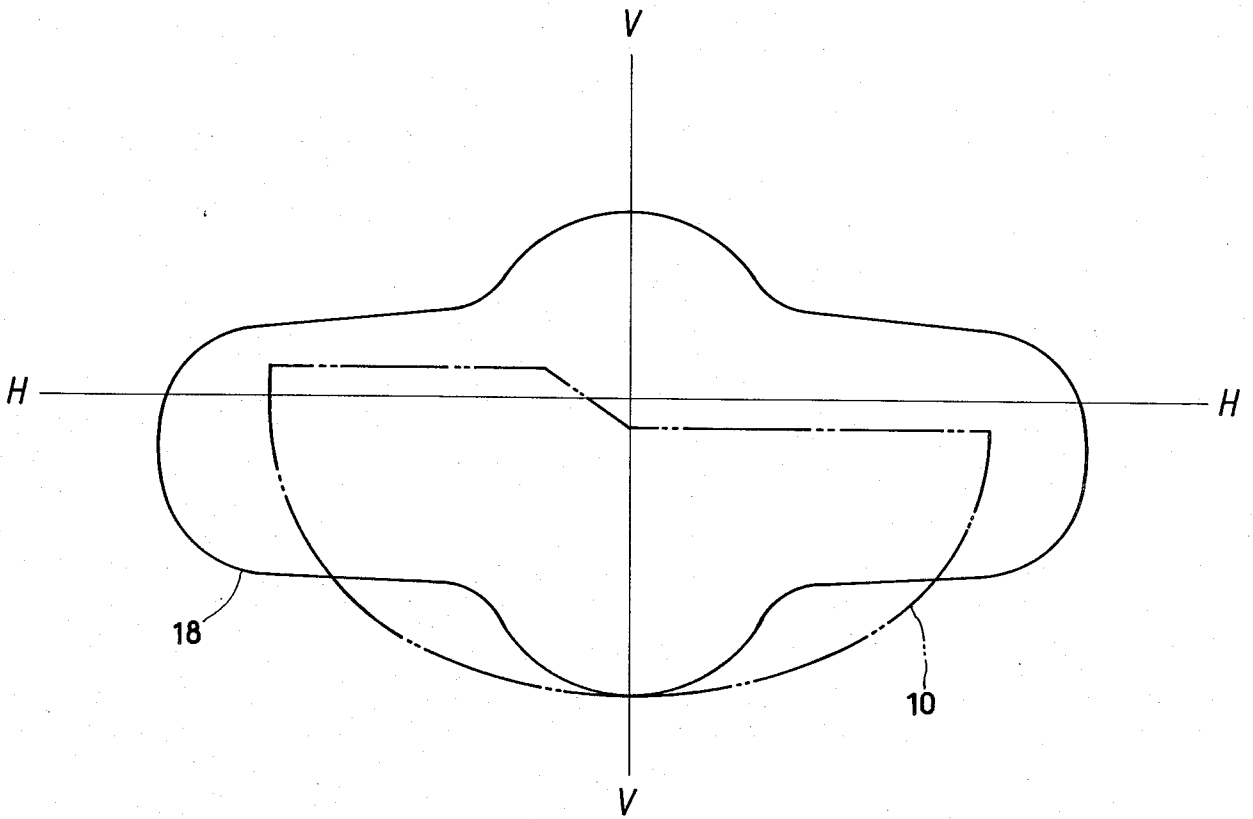
FIG. 4 is a drawing of a projected beam pattern provided by the first modification of FIG. 3.

Referring to FIGS. 3 and 4, particularly FIG. 3, there is shown a first modification of the headlight, which is generally designated by numeral 12.

Designated by numeral 13 is a main light reflector which has a parabolic light reflecting surface 14 whose upper half is cut out. The main reflector 13 is arranged below the concave light reflector 2 and integral therewith. As has been mentioned hereinbefore, the reflector 2 has the ellipsoidal light reflecting surface 3 formed on an inside face thereof. The line designated by X—X is the axis of the main light reflector 13.

Behind the filament 4, there is arranged a main filament 15. The main filament 15 is located on or at least near a focus f of the main reflector 13. Preferably, the filament 15 is arranged to extend along the axis X—X of the reflector 13. Accordingly, the light rays 16 emitted from the main filament 15 are reflected by the main reflector 13 and directed to travel forward in parallel with the axis X—X.

A corrugated lens 17 is arranged in front of the main reflector 13, through which the parallel light rays 16 from the main light reflector 13 pass to travel forward.

When, with the construction as described hereinabove, the main filament 15 is energized to light, the corrugated lens 17 projects forward a light beam of such a pattern 18 as is shown in FIG. 4, which is a so-called upper beam. The upper beam is intended for a forward distant illumination particularly used when the vehicle is not meeting nor following other vehicles. While, when the other filament 4 is energized having the main filament 15 deenergized, the converging lens 9 projects forward a light beam which includes the above-mentioned well-contoured pattern 10, which is the lower beam.

It is to be noted that the filaments 4 and 15 and the cap 5 for the filament 4 may be installed in a single glass bulb. This bulb is called "double filaments bulb".

Figure 5:
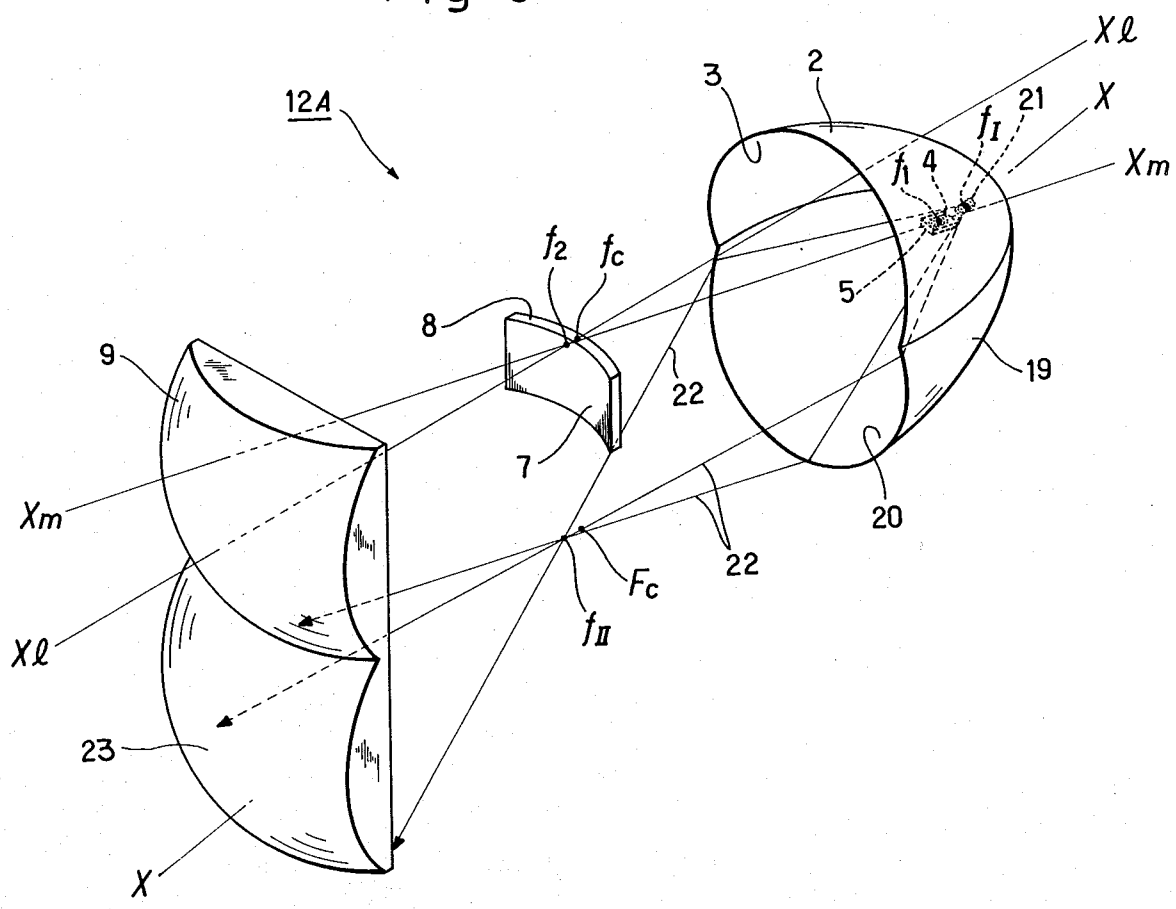
FIG. 5 is a view similar to FIG. 3, but showing a second modification of the present invention.
Figure 6:
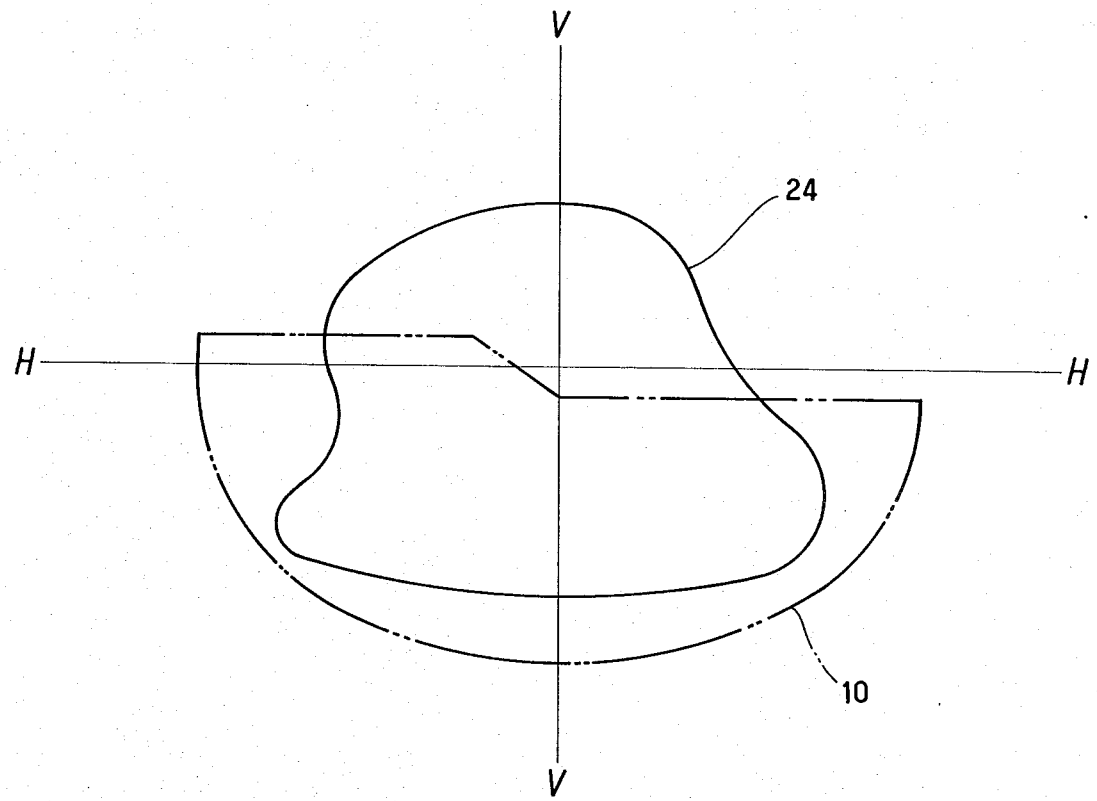
FIG. 6 is a drawing of a projected beam pattern provided by the second modification of FIG. 5.

Referring to FIGS. 5 and 6, particularly FIG. 5, there is shown a second modification of the headlight, which is generally designated by numeral 12A.

Designated by numeral 19 is a main light reflector which has an ellipsoidal light reflecting surface 20 whose upper half is cut out. The main reflector 19 is arranged below the concave light reflector 2 and integral therewith. The line designated by X—X is the axis of the main reflector 19, which is somewhat inclined with respect to the above-mentioned axis Xl—Xl of the converging lens 9. That is, the main reflector 19 faces forward but somewhat downward.

Behind the filament 4, there is arranged a main filament 21 which is located on or at least near a first focus $f_I$ of the main reflector 19. Accordingly, the light rays 22 emitted from the main filament 21 are reflected forward by the main reflector 19 and converged at a second focus $f_{II}$ of the main reflector 19.

A main converging lens 23 is arranged in front of the second focus $f_{II}$ of the main reflector 19. That is, the main converging lens 23 is so positioned that a focus $F_C$ thereof is located near the second focus $f_{II}$ of the main reflector 19.

When, with the construction as described hereinabove, the main filament 21 is energized to light, the converging lens 23 projects forward a light beam in which an inverted image of the neighbourhood of the second focus $f_{II}$ is included. Thus, such a well-contoured pattern 24 as shown in FIG. 6 is projected from the lens 23, which is used as an upper beam. While, when the other filament 4 is energized having the main filament 21 deenergized, the other converging lens 9 projects the lower beam of the pattern 10 (see FIG. 6) in the same manner as has been described in the first modification.

Figure 7:
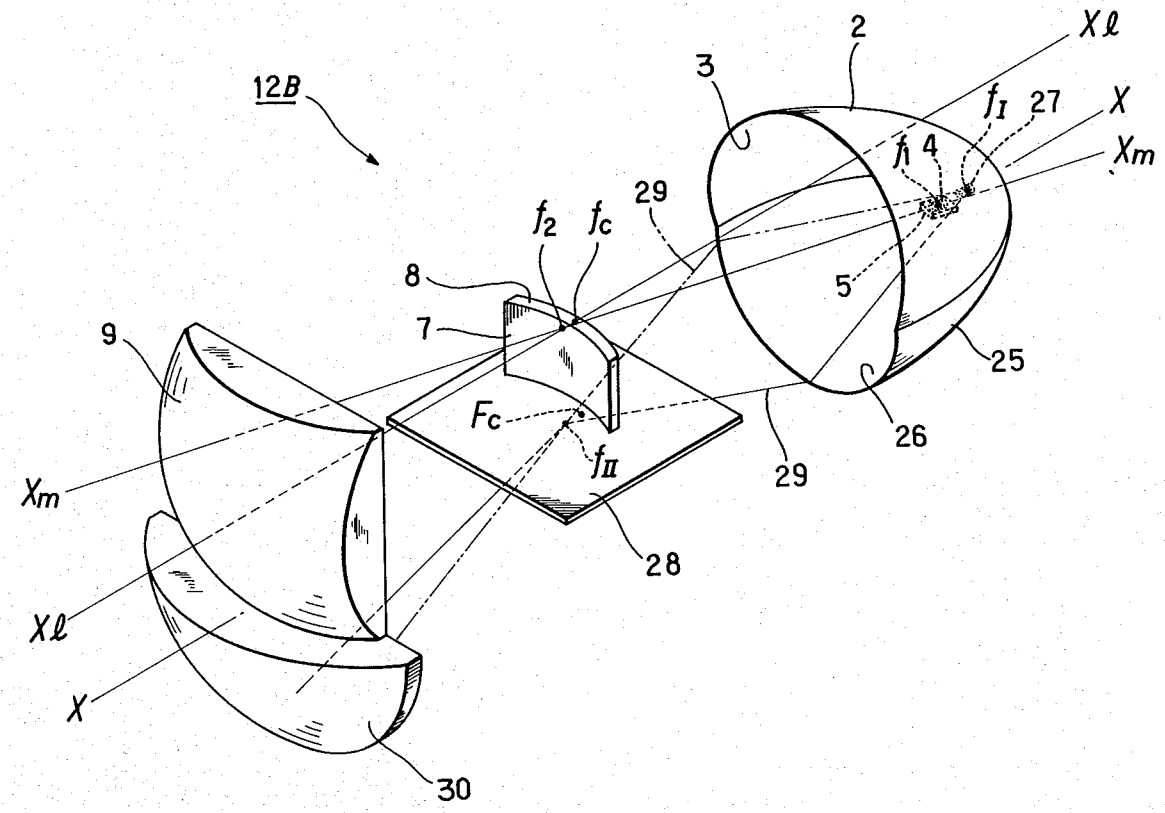
FIG. 7 is a view also similar to FIG. 3, but showing a third modification of the present invention.
Figure 8:
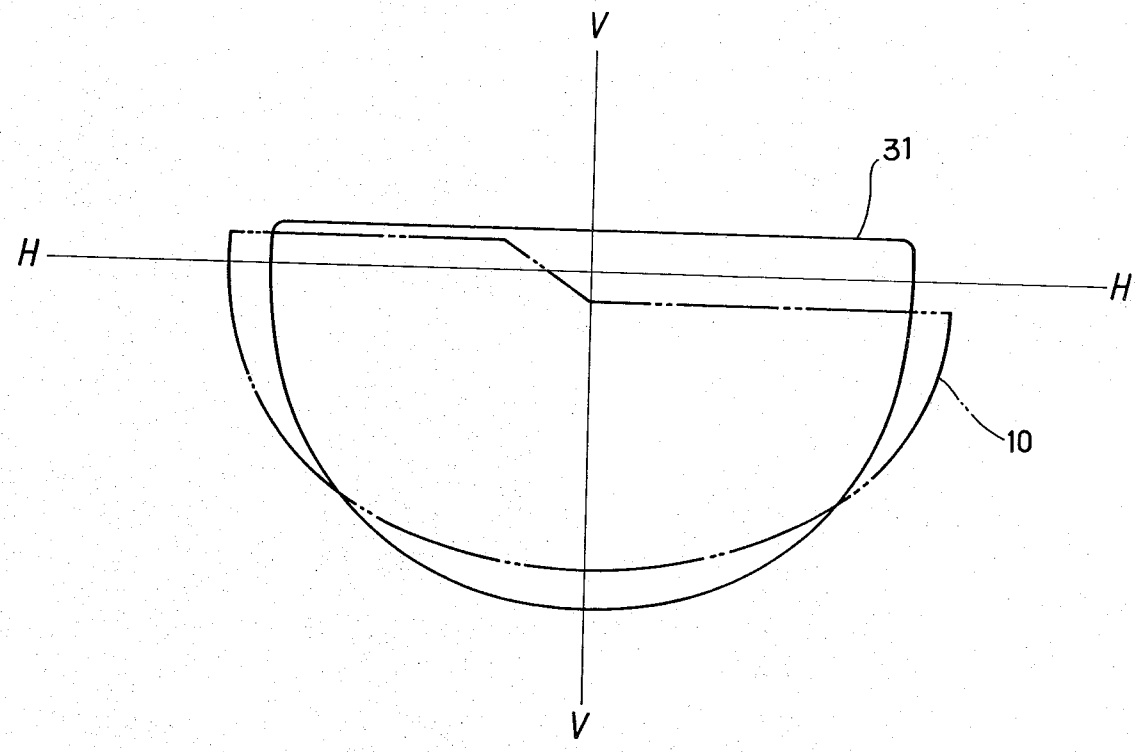
FIG. 8 is a drawing of a projected beam pattern provided by the third modification of FIG. 7.

Referring to FIGS. 7 and 8, particularly FIG. 8, there is shown a third modification of the headlight, which is generally designated by numeral 12B.

Designated by numeral 25 is a main light reflector which has an ellipsoidal light reflecting surface 26 whose upper half is cut out. The main reflector 25 is arranged below the concave light reflector 2 and integral therewith. The line designated by X—X is the axis of the main reflector 25, which is substantially horizontal or slightly inclined with its front part raised. Furthermore, the line X—X is somewhat inclined with respect to the axis Xl—Xl of the converging lens 9. That is, the main light reflector 25 faces forward but somewhat upward.

Behind the filament 4, there is arranged a main filament 27 which is located on or at least near a first focus $f_I$ of the main reflector 25. Preferably, the filament 27 is arranged to extend along the axis X—X.

Designated by numeral 28 is a flat plate whose lower side constitutes a light reflecting surface (viz., mirror). The reflecting plate 28 is located in the vicinity of a second focus $f_{II}$ of the main reflector 25. Thus, the light rays 29 emitted from the main filament 27, reflected forward by the main reflector 25 and directed toward the second focus $f_{II}$ of the reflector 25 are reflected by the reflecting plate 28 to be directed toward a desired direction.

A main converging lens 30 is arranged in front of the reflecting plate 28 at such a position that a focus $F_C$ thereof is located near the second focus $f_{II}$ of the main reflector 25.

When, with the construction as described hereinabove, the main filament 27 is energized, the converging lens 30 projects forward a light beam in which an inverted image of the neighbourhood of the second focus $f_{II}$ is included. Thus, such a pattern 31 as shown in FIG. 8 is projected from the lens 30, which is used as the upper beam. Due to provision of the light reflecting plate 28 by which leakage of the light rays 29 is minimized, the upper beam produced by this third modification is stronger than that of the second modification. When the other filament 4 is energized having the main filament 27 deenergized, the other converging lens 9 projects the lower beam of the pattern 10 (see FIG. 8).

Figure 9:
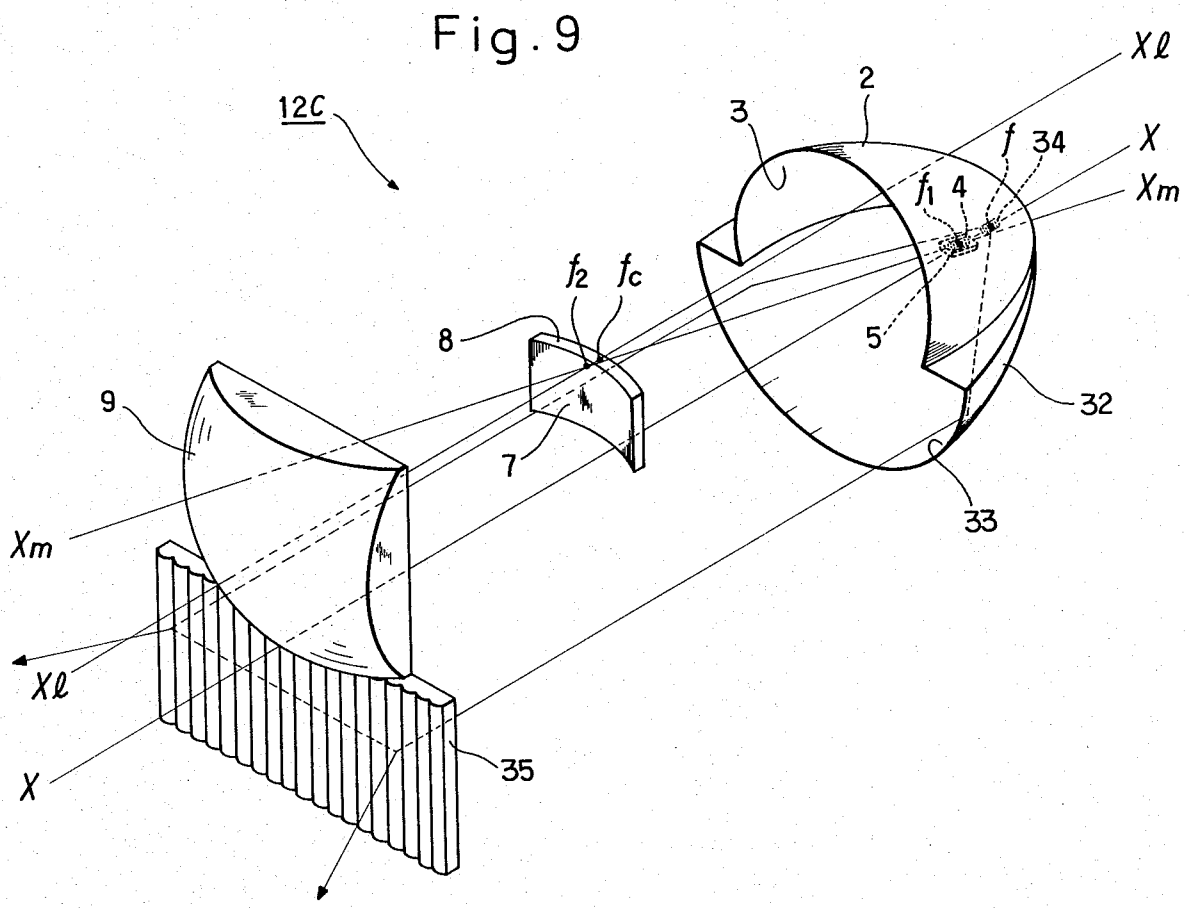
FIG. 9 is a view also similar to FIG. 3, but showing a fourth modification of the present invention.
Figure 10:
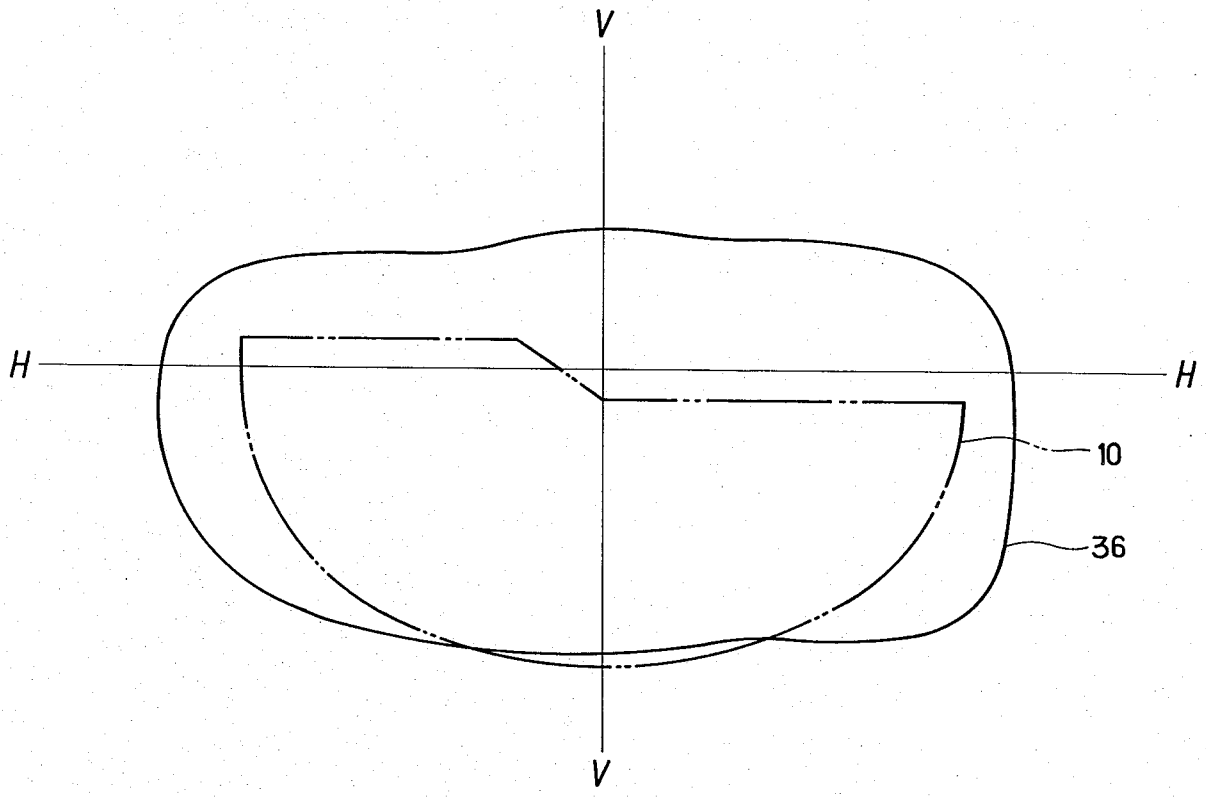
FIG. 10 is a drawing of a projected beam pattern provided the fourth modification of FIG. 9.

Referring to FIGS. 9 and 10, particularly FIG. 9, there is shown fourth modification of the headlight, which is generally designated by numeral 12C.

This modification is similar to the above-mentioned first modification of FIG. 3 except the following.

That is, the main reflector 32 employed in the fourth modification has a combination of various reflecting surfaces 33, such as the surfaces provided by an ellipsoid of revolution, a paraboloid of revolution, a hyperboloid of revolution and the like. Designated by numerals 34 and 35 are a main filament and a corrugated lens which correspond to the main filament 15 and the corrugated lens 17 of the first modification.

With the construction as described hereinabove, the fourth modification projects such an upper beam pattern 36 as shown in FIG. 10.

Figure 11:
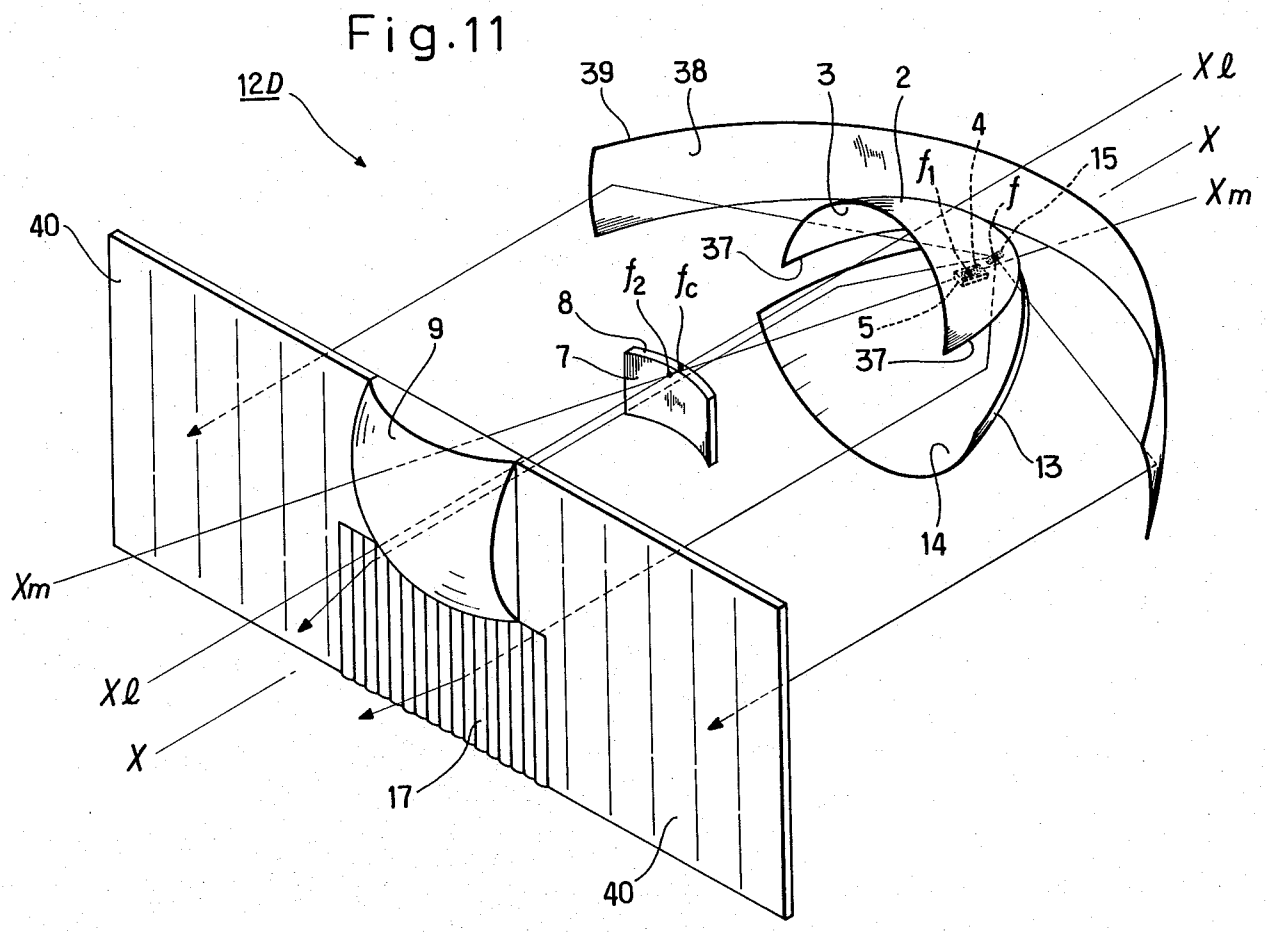
FIG. 11 is a view also similar to FIG. 3, but showing a fifth modification of the present invention.
Figure 12:
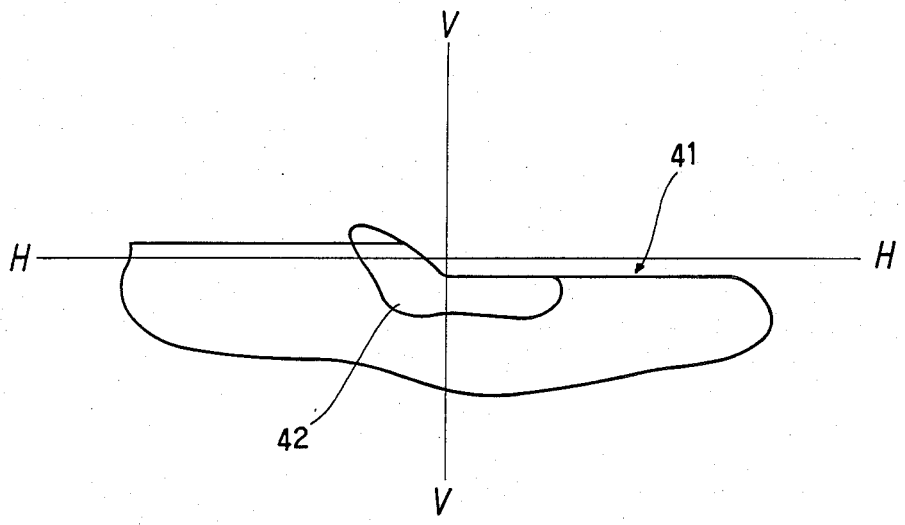
FIG. 12 and 13 are drawings of a projected beam pattern provided by the fifth modification of FIG. 11.
Figure 13:
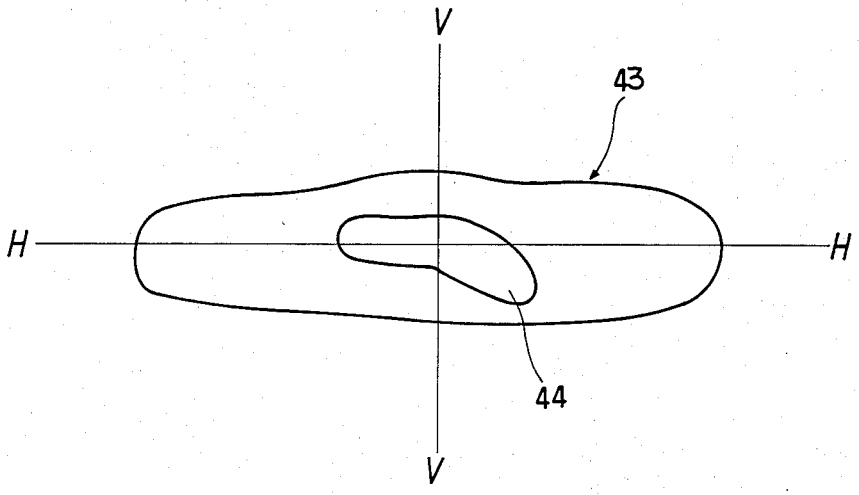
Figure 14:
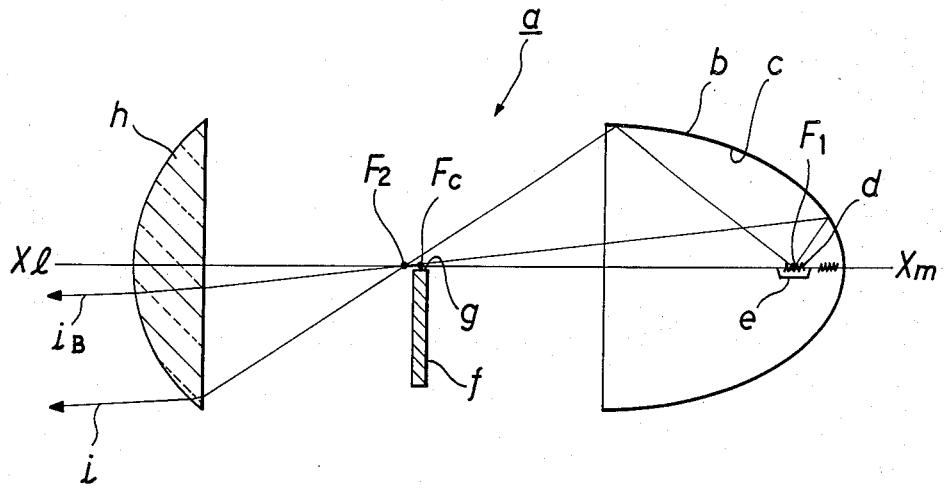
Fig. 14 PRIOR ART
FIG. 14 is a schematical illustration of a conventional projector type headlight.
Figure 15:
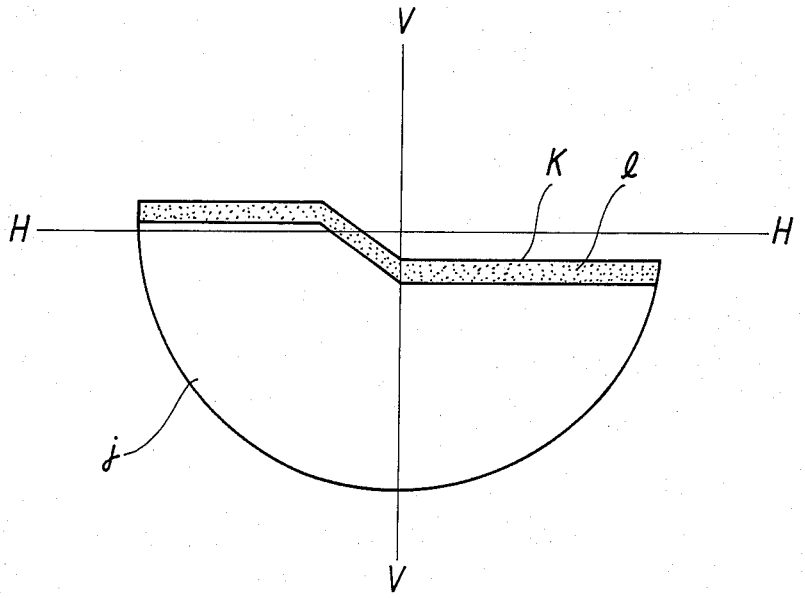
Fig. 15 PRIOR ART
FIG. 15 is a drawing of a projected beam pattern provided by the conventional headlight of FIG. 14.

Referring to FIGS. 11, 12 and 13, particularly FIG. 11, there is shown a fifth modification of the headlight, which is generally designated by numeral 12D.

As is seen from FIG. 11, in this modification, the concave reflector 2 and the main light reflector 13 (19, 25 or 32) are separated from each other with a given clearance 37 defined therebetween. An elongate curved light reflector 39 is arranged outside of the reflectors 2 and 13 and extends along the clearance 37. The inboard light reflecting surface 38 of the light reflector 39 constitutes a part of a paraboloid of revolution.

Designated by numeral 40 is an auxiliary lens which is integral with both the converging lens 9 and the corrugated lens 17. The auxiliary lens 40 is constructed to have a less diffusibility against the light rays applied thereto, so that the light rays from the elongate curved light reflector 39 can pass through the auxiliary lens 40 without being largely deflected. If desired, a converging lens may be employed as a substitute for the corrugated lens 17.

Thus, upon energization of the filament 4, part of the light rays emitted from the filament 4 is reflected forward by the elonagate light reflector 39 and directed toward the auxiliary lens 40. The light rays thus applied to the auxiliary lens 40 are converged by the same thereby producing a stronger illumination area 42 in the lower beam pattern 41 as is shown in FIG. 12.

While, upon energization of the main filament 15, part of the light rays emitted from the filament 15 is reflected forward by the elonagate light reflector 39 and directed toward the auxiliary lens 40. The light rays thus applied to the auxiliary lens 40 are converged by the same thereby producing a stronger illumination area 44 in the upper beam pattern 43 as is shown in FIG. 13.

It is to be noted that usually the filament 4 for the lower beam is also energized when the vehicle is cruising with the headlight assuming the upper beam position.

What is claimed is:

1. A projector type headlight comprising:

a first concave reflector having first and second focuses on an optical axis thereon;

a first light source located on or at least near said first focus of said concave reflector;

a shade plate positioned in front of said concave reflector, said shade plate having an upper edge located in the vicinity of said second focus of the concave reflector; and a first converging lens located in front of said shade plate in such a manner that a focus of the lens is positioned on said upper edge of said shade plate, wherein the optical axis of said concave reflector is inclined with respect to an optical axis of said converging lens.

2. A projector type headlight as claimed in claim 1, in which said concave reflector has an ellipsoidal light reflecting surface formed on an inside face thereof.

3. A projector type headlight as claimed in claim 2, in which said concave reflector has one half of said ellipsoidal light reflecting surface thereof cut out.

4. A projector type headlight as claimed in claim 3, further comprising a cap which partially covers said light source to block the light rays from said light source from travelling toward the cut out part of the concave reflector.

5. A projector type headlight as claimed in claim 4, in which said light source is a filament of an electric bulb.

6. A projector type headlight as claimed in claim 3, further comprising an upper beam projecting unit by which an independent light beam is produced.

7. A projector type headlight as claimed in claim 6, in which said upper beam projecting unit comprises:

a second concave reflector having a parabolic light reflecting surface, said second light reflector being arranged below said first concave light reflector and integral therewith;

a second light source arranged behind said first light source and located on or at least near a focus of said second concave reflector; and a corrugated lens arranged in front of said second concave reflector to pass therethrough light rays which have been emitted from said second light source and reflected by said second concave reflector.

8. A projector type headlight as claimed in claim 7, in which an optical axis of said second concave reflector is in parallel with the optical axis of said first converging lens.

9. A projector type headlight as claimed in claim 7, in which said parabolic light reflecting surface of said second concave light reflector is a combination of various reflecting surfaces which include surfaces provided by an ellipsoid of revolution, a paraboloid of revolution, a hyperboloid of revolution.

10. A projector type headlight as claimed in claim 6, in which said upper beam projecting unit comprises:

a second concave reflector having an ellipsoidal light reflecting surface with first and second focuses, said second concave reflector being arranged below said first concave light reflector and integral therewith;

a second light source arranged behind said first light source and located on or at least near said first focus of said second concave reflector; and a second converging lens arranged in front of said second concave reflector to pass therethrough light rays which have been emitted from said second light source and reflected by said second concave reflector, said second converging lens being positioned in such a manner that a focus thereof is placed near said second focus of said second concave reflector.

11. A projector type headlight as claimed in claim 10, in which an optical axis of said second concave reflector is somewhat inclined with respect to the optical axis of said first converging lens.

12. A projector type headlight as claimed in claim 10 further comprising a flat light reflector which is arranged in the vicinity of said second focus of said second concave reflector.

13. A projector type headlight as claimed in claim 6, further comprising:

means defining between said first and second concave light reflectors a given clearance;

an elongate curved light reflector arranged behind said first and second concave reflectors and extending along said given clearance to reflect the light rays emitted from said first and second light sources forward; and an auxiliary lens integral with both said first converging lens and said corrugated lens, said auxiliary lens being arranged to pass therethrough said light rays from said elongate curved light reflector.

* * * * *